US012215939B2

(12) United States Patent
Nakata et al.

(10) Patent No.: US 12,215,939 B2
(45) Date of Patent: Feb. 4, 2025

(54) HEAT EXCHANGER

(71) Applicant: FUJITSU GENERAL LIMITED, Kanagawa (JP)

(72) Inventors: Shohei Nakata, Kanagawa (JP); Yoshinari Maema, Kanagawa (JP); Kotaro Oka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 186 days.

(21) Appl. No.: 17/909,641

(22) PCT Filed: Mar. 4, 2021

(86) PCT No.: PCT/JP2021/008549
§ 371 (c)(1),
(2) Date: Sep. 6, 2022

(87) PCT Pub. No.: WO2021/192902
PCT Pub. Date: Sep. 30, 2021

(65) Prior Publication Data

US 2023/0108901 A1 Apr. 6, 2023

(30) Foreign Application Priority Data

Mar. 23, 2020 (JP) ..... 2020-051123

(51) Int. Cl.
*F28F 9/02* (2006.01)
*F28D 7/16* (2006.01)
*F28F 1/04* (2006.01)

(52) U.S. Cl.
CPC ..... *F28F 9/0204* (2013.01); *F28D 7/1653* (2013.01); *F28F 1/04* (2013.01); *F28F 9/02* (2013.01)

(58) Field of Classification Search
CPC ... F28F 9/0204; F28F 9/02; F28F 1/04; F28D 7/1653
See application file for complete search history.

(56) References Cited

U.S. PATENT DOCUMENTS 7,284,594 B2 10/2007 Sanada et al.
2018/0073819 A1 3/2018 Kim et al.
(Continued)

FOREIGN PATENT DOCUMENTS

CN 102767922 A 11/2012
CN 104422200 A 3/2015
(Continued)

OTHER PUBLICATIONS

Feb. 22, 2024, European Search Report issued for related EP Application No. 21774084.4.
(Continued)

*Primary Examiner* — Devon Russell
(74) *Attorney, Agent, or Firm* — Paratus Law Group, PLLC

(57) ABSTRACT

A heat exchanger includes a plurality of flat heat transfer tubes and a header, wherein each of the flat heat transfer tubes internally includes a plurality of windward channels and a plurality of leeward channels that are arranged on a leeward side of the windward channels, the header includes a main body unit having an internal space that is connected to the windward channels and the leeward channels, a partition member that separates the internal space into a windward side space at a side of ends of the windward channels and a leeward side space at a side of ends of the leeward channels, and an inflow portion that supplies a refrigerant to the lower portion of the leeward side space, and an upper side communication path that allows communication between the leeward side space and the windward
(Continued)

side space is formed in an upper portion of the partition member.

6 Claims, 12 Drawing Sheets

(56) References Cited

U.S. PATENT DOCUMENTS

| | | | |
|---|---|---|---|
| 2021/0018190 | A1 | 1/2021 | Hirokawa et al. |
| 2022/0316804 | A1 | 10/2022 | Onaka et al. |
| 2023/0094694 | A1 | 3/2023 | Nakata et al. |
| 2023/0108901 | A1 | 4/2023 | Nakata et al. |

FOREIGN PATENT DOCUMENTS

| | | | | | |
|---|---|---|---|---|---|
| CN | 115280092 | A | | 11/2022 | |
| CN | 115298507 | A | | 11/2022 | |
| EP | 3425320 | A1 | | 1/2019 | |
| EP | 3425321 | A1 | | 1/2019 | |
| EP | 3473963 | A1 | | 4/2019 | |
| EP | 3647711 | A1 | | 5/2020 | |
| JP | H03-140795 | A | | 6/1991 | |
| JP | 2016-114282 | A | | 6/2016 | |
| JP | 2016-125748 | A | | 7/2016 | |
| JP | 2017-044428 | A | | 3/2017 | |
| JP | 2018100800 | A | * | 6/2018 | ..... F25B 39/00 |
| JP | 2018162900 | A | * | 10/2018 | |
| JP | 6664558 | B1 | | 3/2020 | |
| WO | WO 2017/149989 | A1 | | 9/2017 | |
| WO | WO 2017/150126 | A1 | | 9/2017 | |
| WO | WO 2018/116929 | A1 | | 6/2018 | |
| WO | WO 2019/026436 | A1 | | 2/2019 | |

OTHER PUBLICATIONS

Oct. 3, 2024, U.S. Office Action issued for related U.S. Appl. No. 17/909,887.

Oct. 1, 2024, Chinese Office Action issued for related CN Application No. 202180020733.X.

Oct. 1, 2024, Chinese Office Action issued for related CN Application No. 202180021247.X.

Chen et al., Development of Compact Heat Exchanger of CO2 Motor Vehicle Air-Conditioning, 2001, pp. 9-12, vol. 22, No. 1.

Aug. 8, 2024, Australian Office Action issued for related AU Application No. 2021241109.

* cited by examiner

HEAT EXCHANGER

CROSS REFERENCE TO PRIOR APPLICATION

This application is a National Stage Patent Application of PCT International Patent Application No. PCT/JP2021/008549 (filed on Mar. 4, 2021) under 35 U.S.C. § 371, which claims priority to Japanese Patent Application No. 2020-051123 (filed on Mar. 23, 2020), which are all hereby incorporated by reference in their entirety.

FIELD

The present invention relates to a heat exchanger.

BACKGROUND

A heat exchanger that is configured such that both ends of a flat heat transfer tube including a plurality of channels are inserted in and connected to two headers and a refrigerant is distributed from one of the headers to the flat heat transfer tube is known (Patent Literatures 1).

In an air conditioner, a refrigerant that is transformed from a gas liquid two phase state to a gaseous state while passing through a heat exchanger that is used as an evaporator is discharged in an overheated state at an outlet side. A temperature difference $\Delta T$ between the refrigerant in the overheated state and air is reduced as compared to the refrigerant in the gas liquid two phase state, and therefore, a heat exchange amount $\phi$ ($=K*\Delta T*A$, where K is an over heat transfer coefficient and A is a heat transfer area) with respect to air is reduced. Furthermore, if a degree of dryness of the refrigerant at the outlet of the heat exchanger is lower than 1.0, an average degree of dryness of the refrigerant that passes through the heat exchanger is reduced as compared to a case in which the degree of dryness of the refrigerant that has passed through the heat exchanger is 1.0. If the degree of dryness of the refrigerant that passes through the heat exchanger is reduced, a flow speed of the refrigerant is reduced, so that a heat transfer coefficient on the refrigerant side increases. If the heat transfer coefficient on the refrigerant side increases, the over heat transfer coefficient K between the refrigerant and air is reduced, so that the heat exchange amount $\phi$ between the refrigerant and air is reduced. Therefore, when the heat exchanger is used as an evaporator, it is ideal to adjust a circulation amount of refrigerant such that the degree of dryness of the refrigerant that has passed through the heat exchanger reaches just 1.0.

CITATION LIST

Patent Literature

Patent Literature 1: Japanese Laid-open Patent Publication No. 2018-100800

SUMMARY

Technical Problem

Meanwhile, when heat exchange is performed between external air and a refrigerant by using the heat exchanger as described above, a temperature difference with respect to passing air is large in a channel that is located on a windward side in the flat heat transfer tube, and therefore, a heat exchange amount increases. Therefore, when the heat exchanger is used as an evaporator for example, only a refrigerant that flows in the channel that is located on the windward side in the flat heat transfer tube is transformed into a gaseous state, and the gasified refrigerant may be overheated. In contrast, to prevent the refrigerant that flows in the channel located on the windward side from being gasified and overheated, it may be possible to cause a refrigerant with a low degree of dryness to flow into the flat heat transfer tube. However, a heat exchange amount in a channel that is located on a leeward side in the flat heat transfer tube is lower than that of the channel that is located on the windward side in the flat heat transfer tube. Therefore, heat exchange is not sufficiently performed between the refrigerant that flows in the channel located on the leeward side in the flat heat transfer tube and air, so that the degree of dryness of the refrigerant that has passed through the channel is reduced to below 1.0. In this case, there is a problem in that, as compared to an ideal case in which the circulation amount of refrigerant is adjusted such that the degree of dryness of the refrigerant that has passed through the heat exchanger reaches just 1.0, the over heat transfer coefficient K between the refrigerant and air is reduced, so that the heat exchange amount $\phi$ with respect to air is reduced.

The disclosed technology has been conceived in view of the foregoing situation, and an object of the disclosed technology is to provide a heat exchanger that prevents reduction in a heat exchange amount between air and a refrigerant.

Solution to Problem

According to an aspect of an embodiment, a heat exchanger includes a plurality of flat heat transfer tubes that are arranged in a region in which air flows, and a header that is bonded to end portions of the plurality of flat heat transfer tubes, wherein each of the plurality of flat heat transfer tubes internally includes a plurality of windward channels, and a plurality of leeward channels that are arranged on a leeward side of the air relative to the plurality of windward channels, the header includes a main body unit having an internal space that is connected to the plurality of windward channels and the plurality of leeward channels, a partition member that separates the internal space into a windward side space at a side closer to end portions of the plurality of windward channels and a leeward side space at a side closer to end portions of the plurality of leeward channels, and an inflow portion that supplies a refrigerant to the lower portion of the leeward side space, and an upper side communication path that allows communication between the leeward side space and the windward side space is formed in an upper portion of the partition member.

Advantageous Effects of Invention

The disclosed heat exchanger is able to prevent reduction in a heat exchange amount between air and a refrigerant.

DESCRIPTION OF EMBODIMENTS

Modes (hereinafter, referred to as "embodiments") for carrying out the present invention will be described below with reference to the accompanying drawings. Meanwhile, the same components are denoted by the same reference symbols throughout the descriptions of the embodiments.

First Embodiment

Air Conditioner

Figure 1:
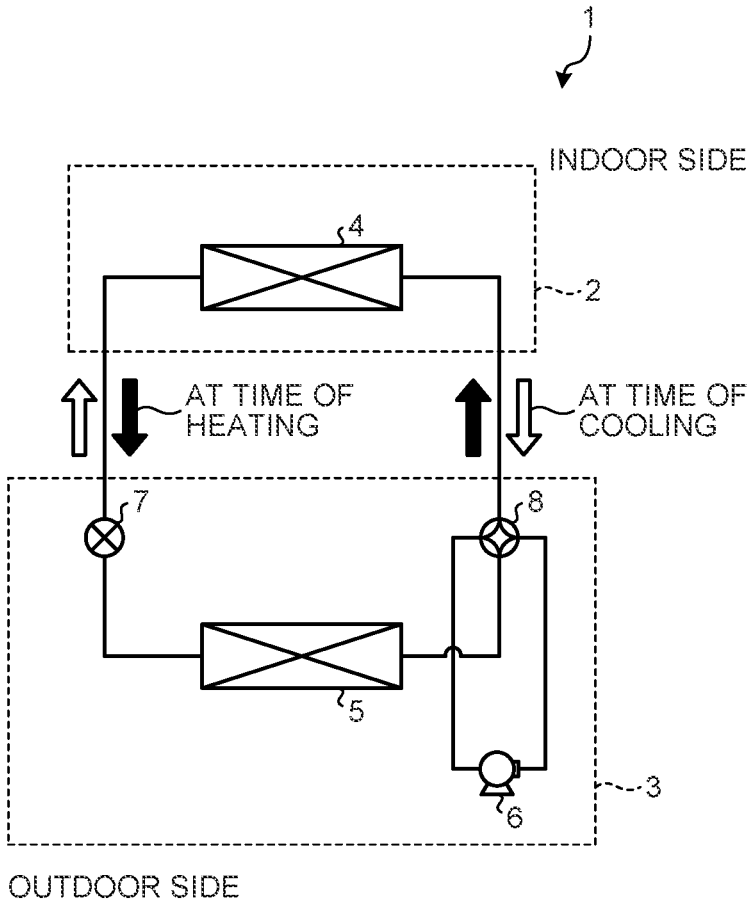
FIG. 1 is a diagram for explaining a configuration of an air condition to which heat exchangers according to a first embodiment of the present invention are applied.
Figure 11:
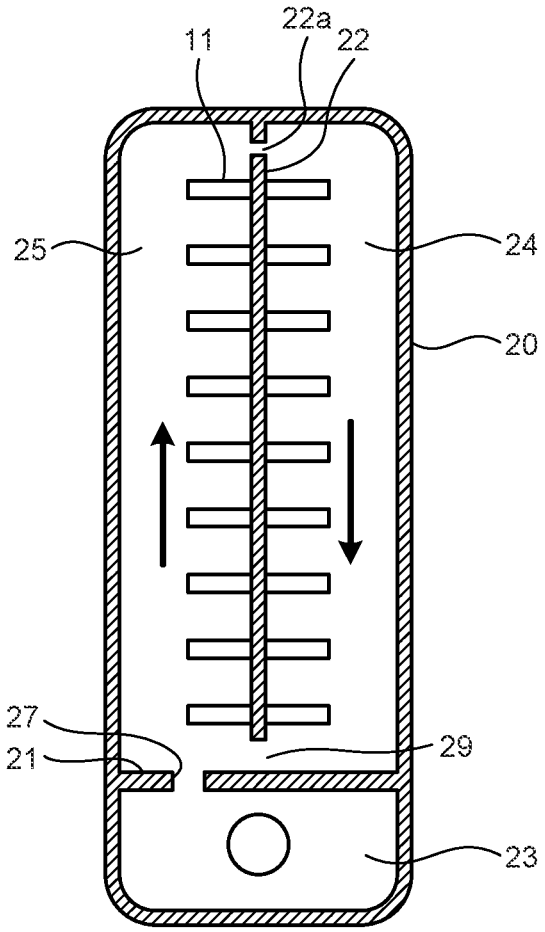
FIG. 11 is a vertical cross sectional view of a header according to a modification.

FIG. 1 is a diagram for explaining a configuration of an air conditioner 1 to which a heat exchanger 4 and a heat exchanger 5 according to a first embodiment of the present invention are applied. As illustrated in FIG. 11, the air conditioner 1 includes an indoor unit 2 and an outdoor unit 3. The heat exchanger 4 for indoor use is arranged in the indoor unit 2, and the heat exchanger 5 for outdoor use, a compressor 6, an expansion valve 7, and a four way valve 8 are arranged in the outdoor unit 3.

At the time of heating operation, a high temperature high pressure gas refrigerant that is discharged from the compressor 6 of the outdoor unit 3 flows into the heat exchanger 4, which functions as a condenser, via the four way valve 8. At the time of heating operation, the refrigerant flows in a direction indicated by black arrows in FIG. 1. In the heat exchanger 4, the gas refrigerant that has flown into the heat exchanger 4 is subjected to heat exchange with external air and liquefied. The liquefied high pressure refrigerant is depressurized by passing through the expansion valve 7, and flows, as a low temperature low pressure gas liquid two phase refrigerant, into the heat exchanger 5 that functions as an evaporator. In the heat exchanger 5, the gas liquid two phase refrigerant that has flown into the heat exchanger 5 is subjected to heat exchange with external air and then gasified. The gasified low pressure refrigerant is sucked by the compressor 6 via the four way valve 8.

At the time of cooling operation, a high temperature high pressure gas refrigerant that is discharged from the compressor 6 of the outdoor unit 3 flows into the heat exchanger 5, which functions as a condenser, via the four way valve 8. At the time of cooling operation, the refrigerant flows in a direction indicated by white arrows in FIG. 1. In the heat exchanger 5, the gas refrigerant that has flown into the heat exchanger 5 is subjected to heat exchange with external air and then liquefied. The liquefied high pressure refrigerant is depressurized by passing through the expansion valve 7, and flows, as a low temperature low pressure gas liquid two phase refrigerant, into the heat exchanger 4 that functions as an evaporator. In the heat exchanger 4, the gas liquid two phase refrigerant that has flown into the heat exchanger 4 is subjected to heat exchange with external air and gasified. The gasified low pressure refrigerant is sucked by the compressor 6 via the four way valve 8.

Heat Exchanger

Figure 2A:
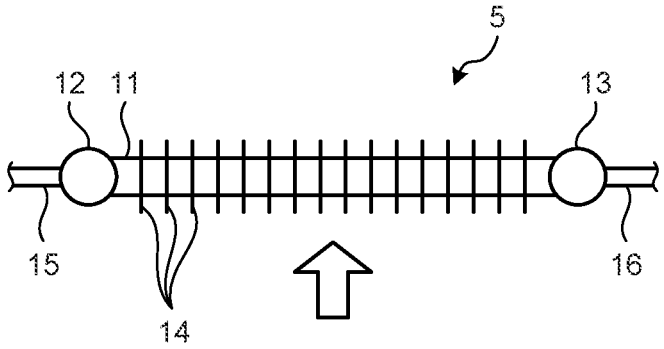
FIG. 2A is a plan view of the heat exchanger according to the first embodiment of the present invention.
Figure 2B:
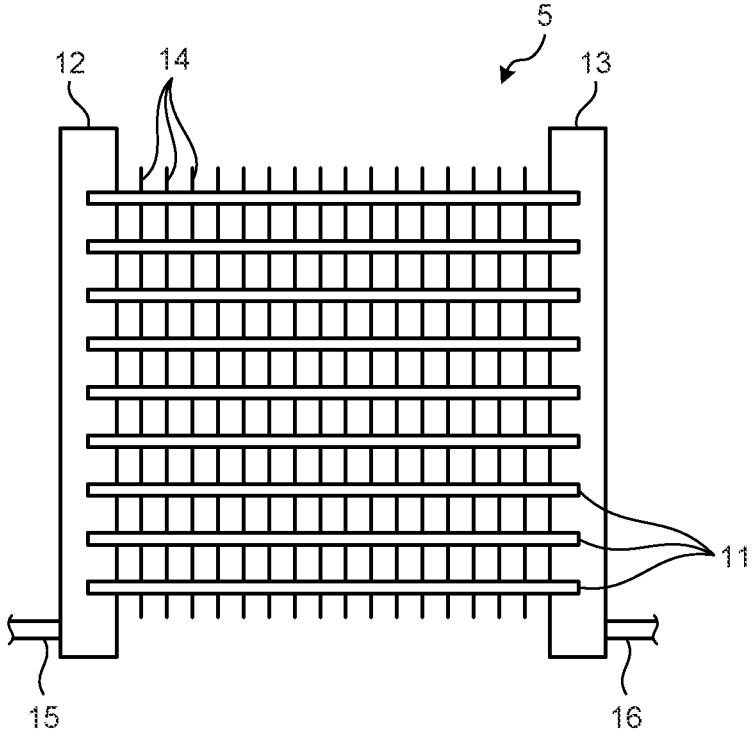
FIG. 2B is a front view of the heat exchanger according to the first embodiment of the present invention.

The heat exchanger according to the first embodiment is applicable to both of the heat exchanger 4 and the heat exchanger 5, but explanation will be given based on the assumption that the heat exchanger is adopted as the heat exchanger 5 that functions as an evaporator at the time of heating operation. FIG. 2A and FIG. 2B are diagrams for explaining the heat exchanger 5 according to the first embodiment of the present invention. FIG. 2A is a plan view of the heat exchanger 5, and FIG. 2B is a front view of the heat exchanger 5.

The heat exchanger 5 includes a plurality of flat heat transfer tubes 11 which are laminated such that wide surfaces face one another and in which a refrigerant is distributed, a tubular header 12 to which one ends of the plurality of flat heat transfer tubes 11 are connected and which distributes the refrigerant to the flat heat transfer tubes 11, a tubular header 13 to which other ends of the plurality of flat heat transfer tubes 11 are connected and in which the refrigerants discharged from the flat heat transfer tubes 11 flow together, and a plurality of flat plate shaped fins 14 that are bonded to the flat heat transfer tubes 11. The flat heat transfer tubes 11 extend in a direction perpendicular to a direction in which external air is distributed as indicated by an arrow in FIG. 2A, and have flat shaped cross sections. Here, the external air is distributed by air blowing performed by a fan (not illustrated). The flat heat transfer tubes 11 include, inside thereof, a plurality of channels that extend in the same direction as a direction in which the flat heat transfer tubes 11 extend. As illustrated in FIG. 2B, the flat heat transfer tubes 11 are laminated in a vertical direction such that flat surfaces (wide surfaces) among side surfaces face one another, and left and right ends are connected to the header 12 and the header 13. Furthermore, the plurality of fins 14 are arranged so as to be perpendicular to the flat heat transfer tubes 11 between the header 12 and the header 13. The low temperature low pressure gas liquid two phase refrigerant that is depressurized by passing through the expansion valve 7 is supplied to the header 12 via a pipe 15, and distributed to each of the flat heat transfer tubes 11. The gas liquid two phase refrigerants that have been subjected to heat exchange with air via the fins 14 when passing through the flat heat transfer tubes 11 are gasified and discharged to the header 13, and the gas refrigerants that flow together in the header 13 are sucked by the compressor 6 via a pipe 16 and the four way valve 8.

Flat Heat Transfer Tube

Figure 3:
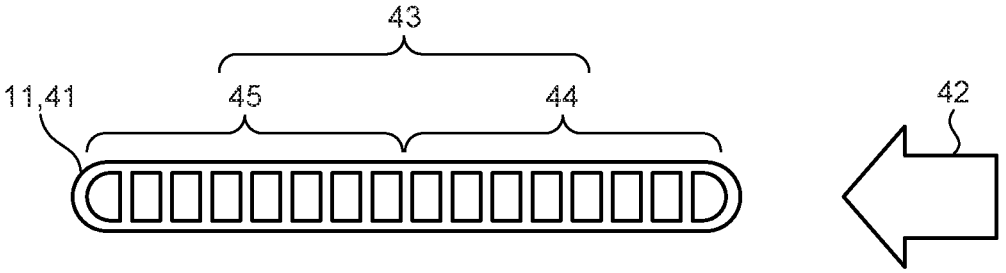
FIG. 3 is a front view of a flat heat transfer tube of the heat exchanger according to the first embodiment of the present invention.

As illustrated in FIG. 3, one flat heat transfer tube 41 among the plurality of flat heat transfer tubes 11 is arranged in a space in which air flows in a distribution direction 42 that is perpendicular to the vertical direction in which the plurality of flat heat transfer tubes 11 are laminated. FIG. 3 is a front view of the flat heat transfer tube 41 of the heat exchanger according to the first embodiment of the present invention. The flat heat transfer tube 41 is formed in an approximately flat belt like shape. A straight line along a longitudinal direction of the flat heat transfer tube 41 is approximately perpendicular to the distribution direction 42 and approximately perpendicular to the vertical direction. A plane of the flat heat transfer tube 41 along a wide surface is approximately perpendicular to the vertical direction, that is, approximately parallel to the distribution direction 42. A plurality of channels 43 that are aligned in the distribution direction 42 are formed inside the flat heat transfer tube 41. The plurality of channels 43 include a plurality of windward channels 44 that are located on a windward side relative to a center of the flat heat transfer tube 41 in a width direction in the cross section, and a plurality of leeward channels 45 that are located on a leeward side relative to the center of the flat heat transfer tube 41 in the width direction in the cross section. The plurality of leeward channels 45 are arranged on the leeward side relative to the plurality of windward channels 44. The flat heat transfer tubes other than the flat heat transfer tube 41 among the plurality of flat heat transfer tubes 11 are formed in the same manner as the flat heat transfer tube 41, and the plurality of channels 43 are aligned in a direction along the distribution direction 42.

Header

Figure 4:
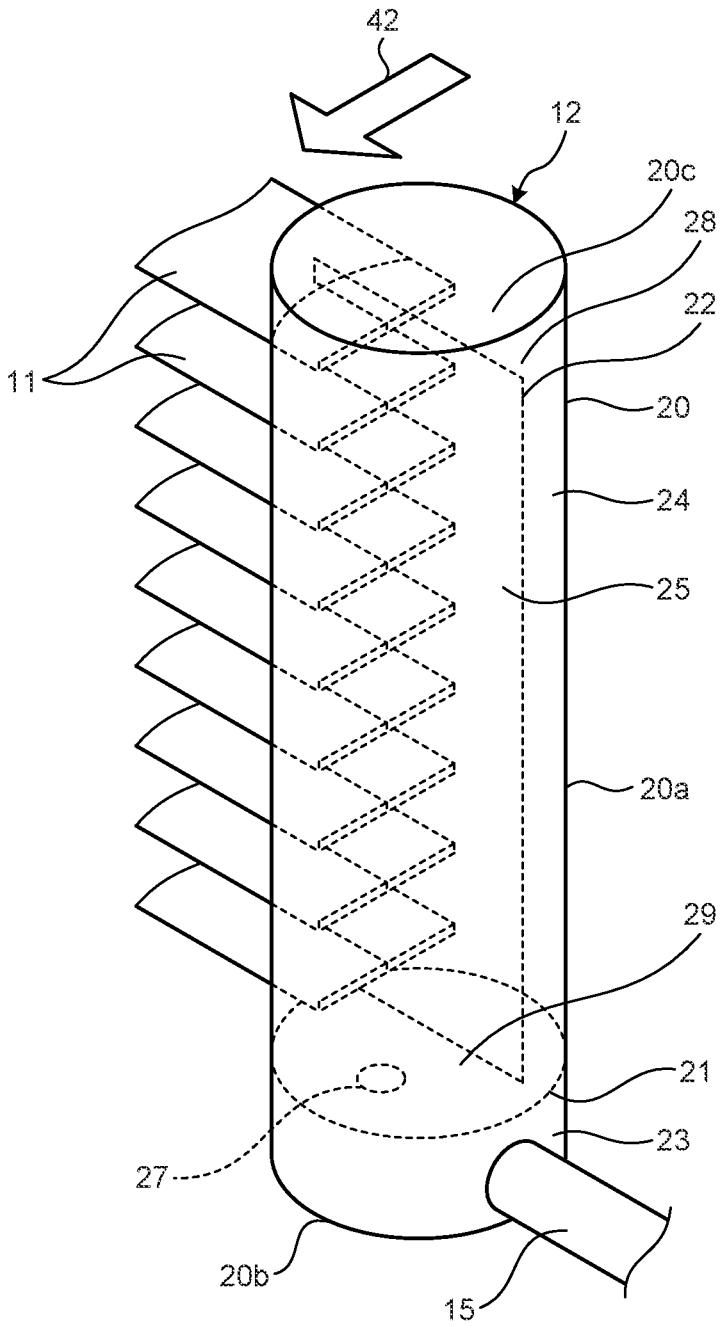
FIG. 4 is a perspective view of a header of the heat exchanger according to the first embodiment of the present invention.
Figure 5:
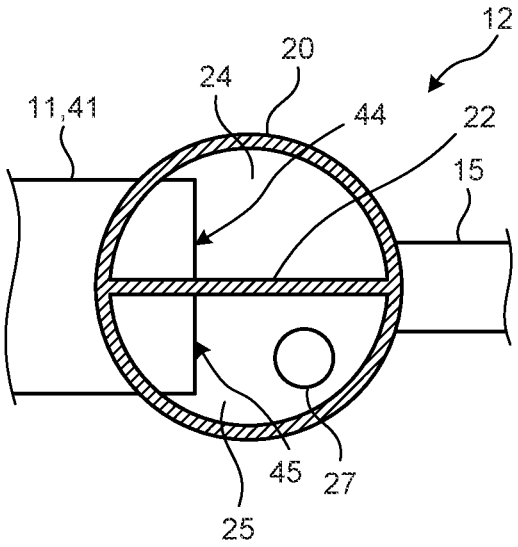
FIG. 5 is a horizontal cross sectional view of the header in FIG. 4.
Figure 6:
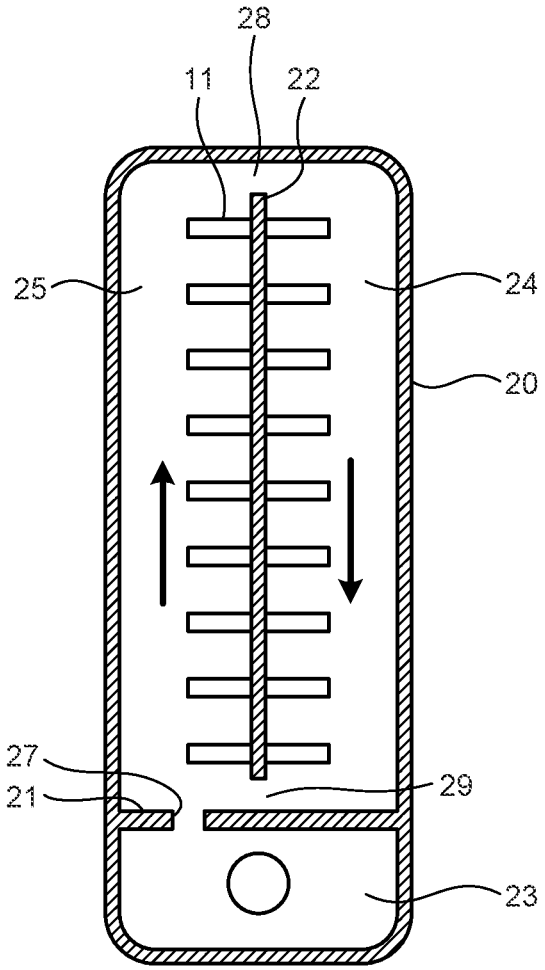
FIG. 6 is a vertical cross sectional view of the header in FIG. 4.

The header 12 according to the first embodiment of the present invention will be described below with reference to FIG. 4 to FIG. 6. FIG. 4 is a perspective view of the header 12 of the heat exchanger according to the first embodiment of the present invention. FIG. 5 is a horizontal cross sectional view of the header 12. FIG. 6 is a vertical cross sectional view of the header 12. Meanwhile, in the present specification, one side of the header 12 at the side of the flat heat transfer tubes 11 will be referred to as an inner side, the other side of the header 12 opposite to the flat heat transfer tubes 11 will be referred to as an outer side, an upstream side of external air will be referred to as a windward side, and a downstream side of the external air will be referred to as a leeward side. In FIG. 4, illustration of the fins 14 is omitted.

The header 12 includes a main body unit 20 that has a tubular shape, a first partition member 21 that is arranged inside the main body unit 20, and a second partition member 22 that is arranged inside the main body unit 20. The main body unit 20 includes a cylindrical portion 20*a* that has a cylindrical shape and that extends in the vertical direction, a lower wall 20*b* that closes a lower end opening of the cylindrical portion 20*a*, and an upper wall 20*c* that closes an upper end opening of the cylindrical portion 20*a*. In other words, the main body unit 20 has a hollow shape. As illustrated in FIG. 4 and FIG. 5, the header 12 having the cylindrical shape is used, but the header 12 need not always be formed in the cylindrical shape, but may be formed in a hollow rectangular columnar shape or the like. Furthermore, as illustrated in FIG. 4 and FIG. 5, the header 12 includes the first partition member 21 that separates the tubular main body unit 20 into two spaces that are aligned in the vertical direction, and the second partition member 22 that separates an upper portion that is separated by the first partition member 21 in the main body unit 20 into two spaces that are aligned in an air flow direction. The first partition member 21 is arranged all over the cylindrical portion 20*a* in the horizontal direction, and the second partition member 22 is arranged all over the upper portion above the first partition member 21 in the main body unit 20 in the vertical direction.

The lower portion that is separated by the first partition member 21 in the main body unit 20 is a refrigerant inflow space 23 to which a low temperature low pressure gas liquid two phase refrigerant flows from the expansion valve 7 via the pipe 15. Further, in the upper portion that is separated by the second partition member 22 and the first partition member 21 in the main body unit 20, a space on the windward side of external air is a windward side space 24, and a space on the leeward side of the external air is a leeward side space 25.

A leeward side inflow port 27 is arranged on the leeward side of the first partition member 21, that is, on the first partition member 21 that serves as a bottom surface of the leeward side space 25. An upper edge of the second partition member 22 is separated from the upper wall 20*c*, so that an upper side communication path 28 that allows communication between the windward side space 24 and the leeward side space 25 is formed above the second partition member 22. In the vicinity of a lower portion of the second partition member 22, a lower edge of the second partition member 22 is separated from the first partition member 21, so that a lower side communication path 29 that allows communication between the windward side space 24 and the leeward side space 25 is formed.

The plurality of flat heat transfer tubes 11 are bonded to the header 12 such that one ends are arranged inside the main body unit 20. Specifically, the flat heat transfer tube 41 is arranged and bonded to the header 12 such that ends of the plurality of windward channels 44 are arranged in the windward side space 24 and ends of the plurality of leeward channels 45 are arranged in the leeward side space 25. The flat heat transfer tubes other than the flat heat transfer tube 41 among the plurality of flat heat transfer tubes 11 are bonded to the header 12 such that, similarly to the flat heat transfer tube 41, ends of the plurality of windward channels 44 are arranged in the windward side space 24 and ends of the plurality of leeward channels 45 are arranged in the leeward side space 25. Meanwhile, in the second partition member 22, notches are formed so as to be aligned in the vertical direction to prevent interference with one end of the flat heat transfer tube 41.

At Time of Heating Operation

When the air conditioner 1 performs heating operation, a gas liquid two phase refrigerant is supplied to the refrigerant inflow space 23 in the heat exchanger 5 from the expansion valve 7 via the pipe 15. The gas liquid two phase refrigerant that is supplied to the refrigerant inflow space 23 is supplied to a lower portion of the leeward side space 25 via the leeward side inflow port 27 of the first partition member 21. The gas liquid two phase refrigerant that is supplied to the lower portion of the leeward side space 25 flows upward in the leeward side space 25. The gas liquid two phase refrigerant that has flown upward in the leeward side space 25 is supplied to an upper portion of the windward side space 24 via the upper side communication path 28 of the second partition member 22. The gas liquid two phase refrigerant that is supplied to the upper portion of the windward side space 24 flows downward in the windward side space 24. The gas liquid two phase refrigerant that has flown downward in the windward side space 24 is supplied to the lower portion of the leeward side space 25 via the lower side communication path 29 of the second partition member 22. The gas liquid two phase refrigerant that is supplied to the leeward side space 25 via the lower side communication path 29 is pushed upward by the gas liquid two phase refrigerant that is flowing upward in the leeward side space 25, and flows upward in the leeward side space 25 together with the gas liquid two phase refrigerant that is flowing upward in the leeward side space 25.

The gas liquid two phase refrigerant that is present in the windward side space 24 flows into the plurality of windward channels 44 of the plurality of flat heat transfer tubes 11, and flows through the plurality of windward channels 44. The gas liquid two phase refrigerant that is present in the leeward side space 25 flows into the plurality of leeward channels 45 of the plurality of flat heat transfer tubes 11, and flows through the plurality of leeward channels 45. The gas liquid two phase refrigerant that flows through the plurality of windward channels 44 and the plurality of leeward channels 45 is heated by heat exchange with external air of the plurality of flat heat transfer tubes 11, and a liquid refrigerant in the gas liquid two phase refrigerant is gasified, so that a degree of dryness increases and a state change to a gas refrigerant occurs. The gas refrigerant that has flown through the plurality of windward channels 44 and the plurality of leeward channels 45 is supplied to the inside of the header 13, further supplied to the four way valve 8 via the pipe 16, and still further supplied to the compressor 6. In this manner, the heat exchanger 5 can appropriately function as an evaporator when the air conditioner 1 performs heating operation.

The liquid refrigerant in the gas liquid two phase refrigerant that is present in the leeward side space 25 tends to be pushed upward by the gas liquid two phase refrigerant that flows upward in the leeward side space 25 and tends to be accumulated in an upper portion of the leeward side space 25 when a flow rate of the refrigerant that is supplied to the leeward side space 25 via the leeward side inflow port 27 is increased. Therefore, a rate of the liquid refrigerant in the gas liquid two phase refrigerant that is supplied from the leeward side space 25 to the windward side space 24 via the upper side communication path 28 tends to increase as compared to a rate of the liquid refrigerant in the gas liquid two phase refrigerant that is present in the leeward side space 25. Therefore, a rate of the liquid refrigerant in the gas liquid two phase refrigerant that is present in the windward side space 24 increases as compared to a rate of the liquid refrigerant in the gas liquid two phase refrigerant that is present in the leeward side space 25. A mass flow rate of the gas liquid two phase refrigerant that flows into the plurality of windward channels 44 of the plurality of flat heat transfer tubes 11 increases as compared to a mass flow rate of the gas liquid two phase refrigerant that flows into the plurality of leeward channels 45 because the rate of the liquid refrigerant in the gas liquid two phase refrigerant in the windward side space 24 is larger than the rate of the liquid refrigerant in the gas liquid two phase refrigerant in the leeward side space 25.

Air that is subjected to heat exchange with the refrigerant that flows through the plurality of leeward channels 45 is air that has been subjected to heat exchange with the refrigerant that flows through the plurality of windward channels 44. Therefore, a temperature difference between the refrigerant that flows through the plurality of windward channels 44 and the air is larger than a temperature difference between the refrigerant that flows through the plurality of leeward channels 45 and the air. Consequently, an amount of heat that is transmitted from the air to the gas liquid two phase refrigerant that flows through the plurality of windward channels 44 is larger than an amount of heat that is transmitted from the air to the gas liquid two phase refrigerant that flows through the plurality of leeward channels 45. In other words, a relatively large amount of heat is transmitted to a relatively large amount of gas liquid two phase refrigerant that flows through the plurality of windward channels 44, and a relatively small amount of heat is transmitted to a relatively small amount of gas liquid two phase refrigerant that flows through the plurality of leeward channels 45. Therefore, the heat exchanger 5 is able to equalize the degree of dryness of the refrigerant that has passed through the plurality of windward channels 44 and the plurality of leeward channels 45 in the plurality of flat heat transfer tubes 11. Consequently, when the heat exchanger 5 is used as an evaporator, it is possible to achieve an ideal state in which the degree of dryness of the refrigerant that has passed through the heat exchanger 5 reaches approximately 1.0.

In a different heat exchanger in which a refrigerant equally flows through the plurality of channels 43, in some cases, after the entire liquid refrigerant in the gas liquid two phase refrigerant flowing through the plurality of windward channels 44 is gasified, heat is transmitted from air to the gasified gas refrigerant and the gas refrigerant is overheated, whereas the liquid refrigerant in the gas liquid two phase refrigerant flowing through the plurality of leeward channels 45 is not fully subjected to heat exchange with air and does not fully vaporize. In this case, heat exchange between the air and the refrigerant is not efficiently performed. In contrast, the heat exchanger 5 equalizes the degree of dryness of the refrigerant that has passed through the plurality of windward channels 44 and the plurality of leeward channels 45 in the plurality of flat heat transfer tubes 11 to prevent overheating of the gas refrigerant, so that when the heat exchanger 5 is used as an evaporator, it is possible to achieve an ideal state in which the degree of dryness of the refrigerant that has passed through the heat exchanger 5 reaches approximately 1.0.

At Time of Cooling Operation

When the air conditioner 1 performs cooling operation, the gas refrigerant that is compressed by the compressor 6 is supplied to the header 13 in the heat exchanger 5 from the four way valve 8 via the pipe 16. The gas refrigerant that is supplied to the header 13 is approximately equally supplied to the plurality of channels 43 of the plurality of flat heat transfer tubes 11. The gas refrigerant that flows through the plurality of channels 43 is subjected to heat exchange with air that flows outside the plurality of flat heat transfer tubes 11, so that the gas refrigerant is liquefied and a state change to a liquid refrigerant occurs. The liquid refrigerant that has flown through the plurality of channels 43 is supplied to the windward side space 24 and the leeward side space 25 of the header 12. The liquid refrigerant that is supplied to the leeward side space 25 flows downward in the leeward side space 25 and is accumulated in the lower portion of the leeward side space 25. The liquid refrigerant that is accumulated in the lower portion of the leeward side space 25 is supplied to the refrigerant inflow space 23 via the leeward side inflow port 27 of the first partition member 21. The liquid refrigerant that is supplied to the windward side space 24 flows downward in the windward side space 24 and is accumulated in the lower portion of the windward side space 24. When the amount of liquid refrigerant that is accumulated in the lower portion of the leeward side space 25 is fully reduced, the liquid refrigerant that is accumulated in the lower portion of the windward side space 24 is supplied to the lower portion of the leeward side space 25 via the lower side communication path 29, and supplied to the refrigerant inflow space 23 via the leeward side inflow port 27. The liquid refrigerant that is supplied to the refrigerant inflow space 23 is supplied to the expansion valve 7 via the pipe 15. In this manner, the heat exchanger 5 can appropriately function as a condenser when the air conditioner 1 performs cooling operation.

Second Embodiment

Figure 7:
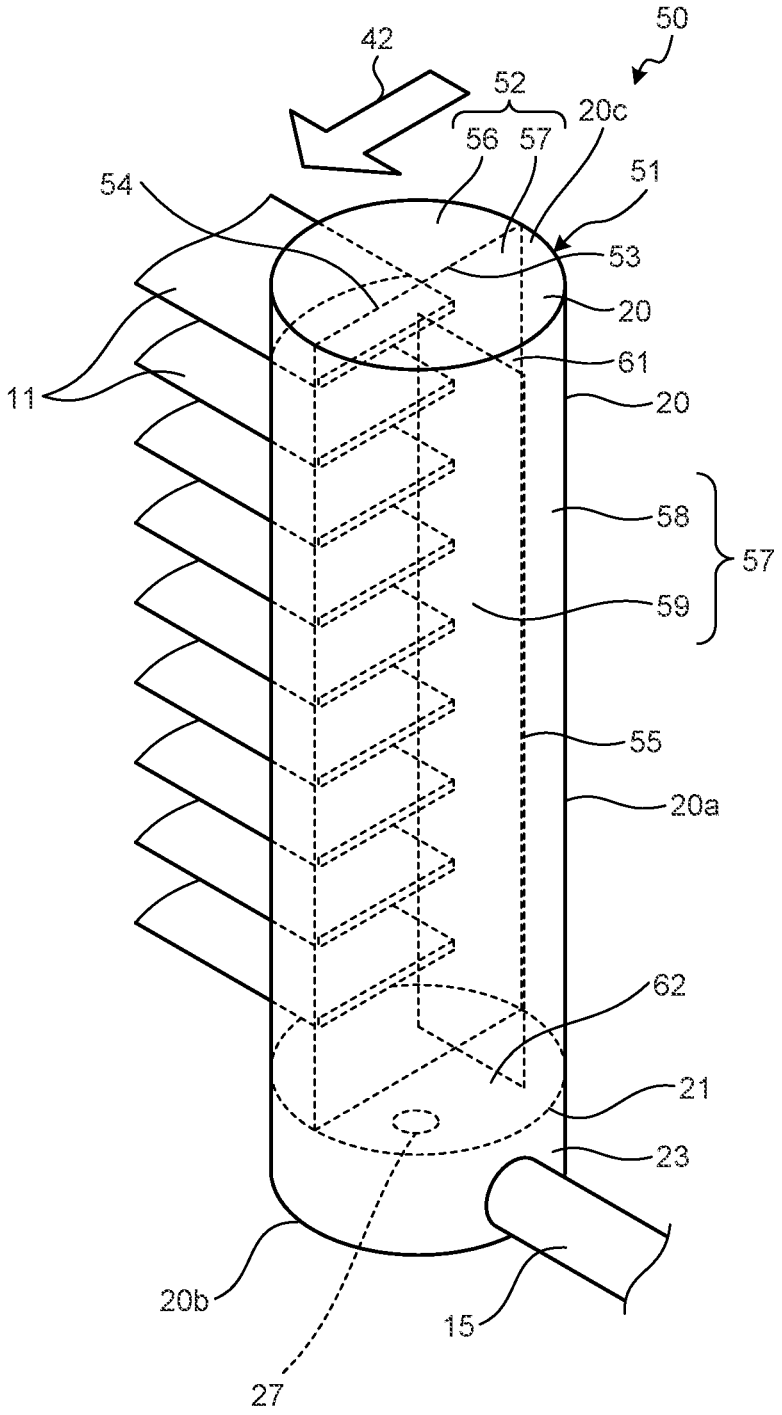
FIG. 7 is a perspective view of a header of a heat exchanger according to a second embodiment of the present invention.

A header 51 used in a heat exchanger 50 according to a second embodiment is configured such that, as illustrated in FIG. 7, the second partition member 22 included in the header 12 of the heat exchanger 5 according to the first embodiment as described above is replaced with a plurality of different partition members, and other configurations are the same as the header 12 as described above. FIG. 7 is a perspective view of the header 51 of the heat exchanger according to the second embodiment of the present invention.

Specifically, the header 51 includes the main body unit 20 and the first partition member 21, similarly to the header 12 as described above. The main body unit 20 is formed in a tubular shape, and an internal space is formed inside the main body unit 20. The first partition member 21 is formed in a disk shape. The first partition member 21 is arranged in the internal space of the main body unit 20 and bonded to the main body unit 20 so as to separate the internal space of the main body unit 20 into the refrigerant inflow space 23 and an upper space 52. The refrigerant inflow space 23 is formed below the first partition member 21 in the internal space of the main body unit 20. The upper space 52 is formed above the first partition member 21 in the internal space of the main body unit 20.

The header 51 further includes a windward side partition member 53, a leeward side partition member 54, and a circulation space partition member 55. The windward side partition member 53 and the leeward side partition member 54 are formed of a single flat plate. The windward side partition member 53 and the leeward side partition member 54 are arranged in the internal space of the main body unit 20 and bonded to the main body unit 20 and the first partition member 21 such that the upper space 52 is separated into a heat transfer tube insertion space 56 that is a space to which one ends of the plurality of flat heat transfer tubes 11 are connected, and a circulation space 57 to which one ends of the plurality of flat heat transfer tubes 11 are not connected. The heat transfer tube insertion space 56 is formed at a side closer to the plurality of flat heat transfer tubes 11 relative to the windward side partition member 53 and the leeward side partition member 54 in the upper space 52. The circulation space 57 is formed at a side away from the plurality of flat heat transfer tubes 11 relative to the windward side partition member 53 and the leeward side partition member 54 in the upper space 52.

The circulation space partition member 55 is formed in a flat plate shape. The circulation space partition member 55 is arranged in the internal space of the main body unit 20 and bonded to the main body unit 20, the windward side partition member 53, and the leeward side partition member 54 so as to separate the circulation space 57 into a windward side space 58 and a leeward side space 59.

The leeward side inflow port 27 that allows communication between the refrigerant inflow space 23 and the leeward side space 59 is formed in the first partition member 21. In an upper portion of the circulation space partition member 55, an upper edge of the circulation space partition member 55 is separated from the upper wall 20*c*, so that an upper side communication path 61 that allows communication between the windward side space 58 and the leeward side space 59 is formed. In the vicinity of a lower portion of the circulation space partition member 55, a lower edge of the circulation space partition member 55 is separated from the first partition member 21, so that a lower side communication path 62 that allows communication between the windward side space 58 and the leeward side space 59 is formed.

Figure 8:
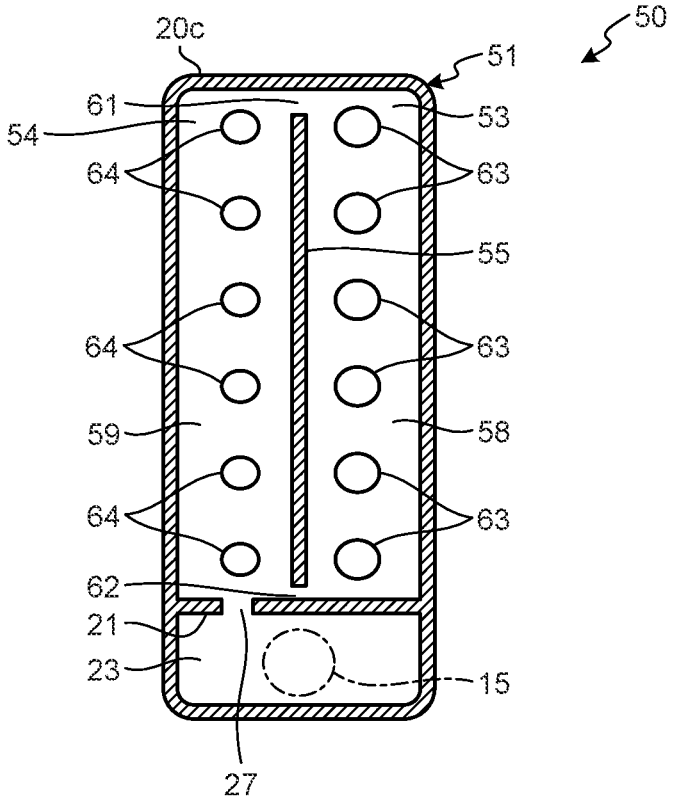
FIG. 8 is a vertical cross sectional view of the header in FIG. 7.

FIG. 8 is a cross sectional view of the header 51 in a top bottom direction (vertical direction) in FIG. 7. A plurality of windward communication holes 63 that allow communication between the windward side space 58 and the heat transfer tube insertion space 56 are formed in the windward side partition member 53. A plurality of leeward communication holes 64 that allow communication between the leeward side space 59 and the heat transfer tube insertion space 56 are formed in the leeward side partition member 54. In this case, a total opening area of the plurality of windward communication holes 63 is larger than a total opening area of the plurality of leeward communication holes 64. With this configuration, a mass flow rate of the gas liquid two phase refrigerant that flows into the plurality of windward channels 44 increases as compared to a mass flow rate of the gas liquid two phase refrigerant that flows into the plurality of leeward channels 45.

Figure 9:
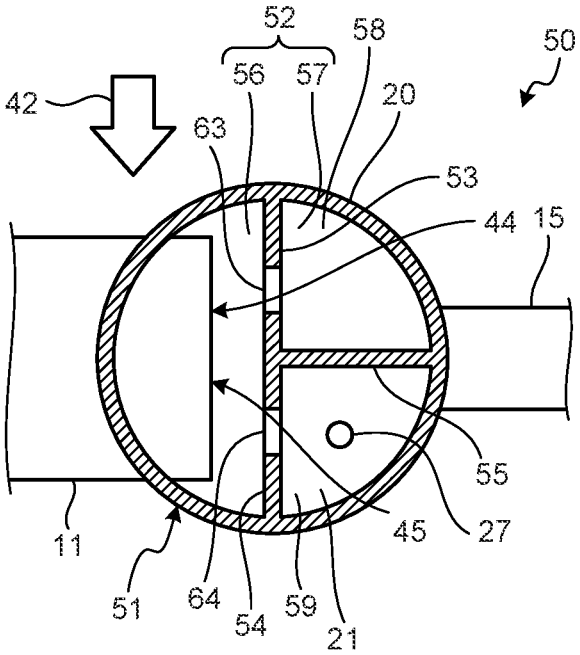
FIG. 9 is a horizontal cross sectional view of the header in FIG. 7.

FIG. 9 is a cross sectional view of the header 51 in a direction (horizontal direction) perpendicular to the top bottom direction in FIG. 7. The windward side space 58 is formed in a region at a side close to end portions of the plurality of windward channels 44 in the circulation space 57. The leeward side space 59 is formed in a region at a side close to end portions of the plurality of leeward channels 45 in the circulation space 57. In this case, the windward side partition member 53 is arranged between the heat transfer tube insertion space 56 and the windward side space 58, and separates the heat transfer tube insertion space 56 and the windward side space 58. The leeward side partition member 54 is arranged between the heat transfer tube insertion space 56 and the leeward side space 59, and separates the heat transfer tube insertion space 56 and the leeward side space 59.

At Time of Heating Operation

The heat exchanger according to the second embodiment operates in approximately the same manner as the heat exchanger 5 according to the first embodiment as described above. Specifically, in the heat exchanger 50, when the air conditioner 1 performs heating operation, a gas liquid two phase refrigerant is supplied to the refrigerant inflow space 23 from the expansion valve 7 via the pipe 15. The gas liquid two phase refrigerant that is supplied to the refrigerant inflow space 23 is supplied to the lower portion of the leeward side space 59 via the leeward side inflow port 27 of the first partition member 21. The gas liquid two phase refrigerant that is supplied to the lower portion of the leeward side space 59 flows upward in the leeward side space 59. The gas liquid two phase refrigerant that has flown upward in the leeward side space 59 is supplied to an upper portion of the windward side space 58 via the upper side communication path 61 of the circulation space partition member 55. The gas liquid two phase refrigerant that is supplied to the upper portion of the windward side space 58 flows downward in the windward side space 58. The gas liquid two phase refrigerant that has flown downward in the windward side space 58 is supplied to the lower portion of the leeward side space 59 via the lower side communication path 62 of the circulation space partition member 55. The gas liquid two phase refrigerant that is supplied to the leeward side space 59 via the lower side communication path 62 is pushed upward by the gas liquid two phase refrigerant that is flowing upward in the leeward side space 59, and flows upward in the leeward side space 59 together with the gas liquid two phase refrigerant that is flowing upward in the leeward side space 59.

The gas liquid two phase refrigerant that is present in the windward side space 58 is supplied to a region in the vicinity of the ends of the plurality of windward channels 44 in the heat transfer tube insertion space 56 via the plurality of windward communication holes 63 of the windward side partition member 53. The gas liquid two phase refrigerant that is present in the region in the vicinity of the ends of the plurality of windward channels 44 in the heat transfer tube insertion space 56 flows into the plurality of windward channels 44 of the plurality of flat heat transfer tubes 11, and flows through the plurality of windward channels 44. The gas liquid two phase refrigerant that is present in the leeward side space 59 is supplied to a region in the vicinity of the ends of the plurality of leeward channels 45 in the heat transfer tube insertion space 56 via the plurality of leeward communication holes 64 of the leeward side partition member 54. The gas liquid two phase refrigerant that is present in the region in the vicinity of the ends of the plurality of leeward channels 45 in the heat transfer tube insertion space 56 flows into the plurality of leeward channels 45 of the plurality of flat heat transfer tubes 11, and flows through the plurality of leeward channels 45. The gas liquid two phase refrigerant that flows through the plurality of windward channels 44 and the plurality of leeward channels 45 is heated by heat exchange with external air of the plurality of flat heat transfer tubes 11, so that the liquid refrigerant in the gas liquid two phase refrigerant is gasified and a state change to a gas refrigerant occurs. The gas refrigerant that has flown through the plurality of windward channels 44 and the plurality of leeward channels 45 is supplied to the inside of the header 13, further supplied to the four way valve 8 via the pipe 16, and still further supplied to the compressor 6. In this manner, the heat exchanger 50 can appropriately function as an evaporator when the air conditioner 1 performs heating operation.

A rate of the liquid refrigerant in the gas liquid two phase refrigerant that is present in the windward side space 58 increases as compared to a rate of the liquid refrigerant in the gas liquid two phase refrigerant that is present in the leeward side space 59 when a flow rate of the refrigerant that is supplied to the leeward side space 59 via the leeward side inflow port 27 is increased, similarly to the heat exchanger 5 of the first embodiment as described above. Therefore, a rate of the liquid refrigerant in the gas liquid two phase refrigerant that is present in the region in the vicinity of the ends of the plurality of windward channels 44 in the heat transfer tube insertion space 56 increases as compared to a rate of the liquid refrigerant in the gas liquid two phase refrigerant that is present in the region in the vicinity of the ends of the plurality of leeward channels 45 in the heat transfer tube insertion space 56. As a result, a mass flow rate of the gas liquid two phase refrigerant that flows into the plurality of windward channels 44 increases as compared to a mass flow rate of the gas liquid two phase refrigerant that flows into the plurality of leeward channels 45 because the rate of the liquid refrigerant in the gas liquid two phase refrigerant in the windward side space 58 is increased as compared to the rate of the liquid refrigerant in the gas liquid two phase refrigerant in the leeward side space 59. Consequently, similarly to the heat exchanger 5 as described above, the heat exchanger 50 is able to equalize the degree of dryness of the refrigerant that has passed through the plurality of windward channels 44 and the plurality of leeward channels 45 in the plurality of flat heat transfer tubes 11. With this configuration, when the heat exchanger 50 is used as an evaporator, it is possible to achieve an ideal state in which the degree of dryness of the refrigerant that has passed through the heat exchanger 50 reaches approximately 1.0.

In a different heat exchanger in which a refrigerant equally flows through the plurality of channels 43, in some cases, after the entire liquid refrigerant in the gas liquid two phase refrigerant flowing through the plurality of windward channels 44 is gasified, heat is transmitted from air to the gasified gas refrigerant and the gas refrigerant is overheated, and, at this time, heat exchange performance is degraded. The heat exchanger 50 equalizes the degree of dryness of the refrigerant that has passed through the plurality of windward channels 44 and the plurality of leeward channels 45 in the plurality of flat heat transfer tubes 11 to prevent overheating of the gas refrigerant, so that when the heat exchanger 50 is used as an evaporator, it is possible to achieve an ideal state in which the degree of dryness of the refrigerant that has passed through the heat exchanger 50 reaches approximately 1.0.

At Time of Cooling Operation

When the air conditioner 1 performs cooling operation, the gas refrigerant that is compressed by the compressor 6 is supplied to the header 13 in the heat exchanger 50 from the four way valve 8 via the pipe 16. The gas refrigerant that is supplied to the header 13 is distributed to the plurality of channels 43 in the plurality of flat heat transfer tubes 11. The gas refrigerant that flows through the plurality of channels 43 is subjected to heat exchange with air that flows outside the plurality of flat heat transfer tubes 11, so that the gas refrigerant is liquefied and a state change to a liquid refrigerant occurs. The liquid refrigerant that has flown through the plurality of channels 43 is supplied to the heat transfer tube insertion space 56 of the header 51. The liquid refrigerant that is supplied to the heat transfer tube insertion space 56 is supplied to the windward side space 58 via the plurality of windward communication holes 63, and further supplied to the leeward side space 59 via the plurality of leeward communication holes 64. The liquid refrigerant that is supplied to the leeward side space 59 flows downward in the leeward side space 59 and is accumulated in the lower portion of the leeward side space 59. The liquid refrigerant that is accumulated in the lower portion of the leeward side space 59 is supplied to the refrigerant inflow space 23 via the leeward side inflow port 27 of the first partition member 21. The liquid refrigerant that is supplied to the windward side space 58 flows downward in the windward side space 58 and is accumulated in the lower portion of the windward side space 58. When the amount of liquid refrigerant that is accumulated in the lower portion of the leeward side space 59 is fully reduced, the liquid refrigerant that is accumulated in the lower portion of the windward side space 58 is supplied to the lower portion of the leeward side space 25 via the lower side communication path 29, and supplied to the refrigerant inflow space 23 via the leeward side inflow port 27. The liquid refrigerant that is supplied to the refrigerant inflow space 23 is supplied to the expansion valve 7 via the pipe 15. In this manner, the heat exchanger 50 can appropriately function as a condenser when the air conditioner 1 performs cooling operation.

Third Embodiment

Figure 10:
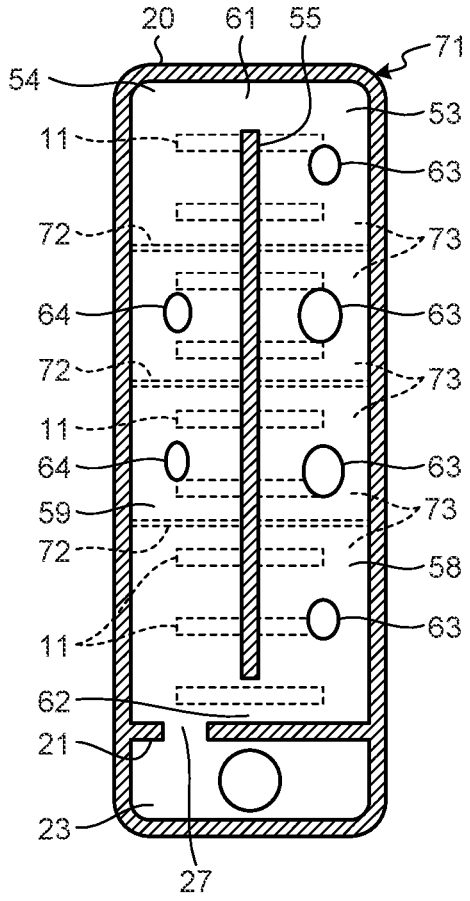
FIG. 10 is a vertical cross sectional view of a header of a heat exchanger according to a third embodiment of the present invention.

A header 71 used in a heat exchanger according to a third embodiment is configured by, as illustrated in FIG. 10, adding a plurality of partition members 72 to the header 51 of the heat exchanger 50 according to the second embodiment. FIG. 10 is a cross sectional view of the header 71 of the heat exchanger according to the third embodiment of the present invention in a top bottom direction (vertical direction). Each of the partition members 72 is formed in an approximately semicircular plate shape. The plurality of partition members 72 are arranged in the heat transfer tube insertion space 56 and bonded to the main body unit 20, the windward side partition member 53, and the leeward side partition member 54 so as to separate the heat transfer tube insertion space 56 into a plurality of heat transfer tube insertion spaces 73. The plurality of partition members 72 are arranged such that an end portion of any of the flat heat transfer tubes 11 is arranged in each of the heat transfer tube insertion spaces 73. Further, the plurality of partition members 72 are arranged such that each of the heat transfer tube insertion spaces 73 communicates with the windward side space 58 via any of the windward communication holes 63.

At Time of Heating Operation

The heat exchanger according to the third embodiment operates in approximately the same manner as the heat exchanger 50 according to the second embodiment as described above. Specifically, in the heat exchanger according to the third embodiment, when the air conditioner 1 performs heating operation, a gas liquid two phase refrigerant is supplied to the refrigerant inflow space 23 from the expansion valve 7 via the pipe 15. The gas liquid two phase refrigerant that is supplied to the refrigerant inflow space 23 flows upward in the leeward side space 59 and flows downward in the windward side space 58, thereby circulating in the circulation space 57. In this case, a rate of the liquid refrigerant in the gas liquid two phase refrigerant that is present in the windward side space 58 increases as compared to a rate of the liquid refrigerant in the gas liquid two phase refrigerant that is present in the leeward side space 59 when a flow rate of the refrigerant that is supplied to the leeward side space 59 via the leeward side inflow port 27 is increased.

The gas liquid two phase refrigerant that is present in the windward side space 58 is supplied to regions in the vicinity of the ends of the plurality of windward channels 44 in the plurality of heat transfer tube insertion spaces 73 via the plurality of windward communication holes 63 of the windward side partition member 53. The gas liquid two phase refrigerant that is present in the regions in the vicinity of the ends of the plurality of windward channels 44 in the plurality of heat transfer tube insertion spaces 73 flows into the plurality of windward channels 44 of the plurality of flat heat transfer tubes 11, and flows through the plurality of windward channels 44. The gas liquid two phase refrigerant that is present in the leeward side space 59 is supplied to regions in the vicinity of the ends of the plurality of leeward channels 45 in the plurality of heat transfer tube insertion spaces 73 via the plurality of leeward communication holes 64 of the leeward side partition member 54. The gas liquid two phase refrigerant that is present in the regions in the vicinity of the ends of the plurality of leeward channels 45 in the plurality of heat transfer tube insertion spaces 73 flows into the plurality of leeward channels 45 of the plurality of flat heat transfer tubes 11, and flows through the plurality of leeward channels 45. The gas liquid two phase refrigerant that flows through the plurality of windward channels 44 and the plurality of leeward channels 45 is heated by heat exchange with external air of the plurality of flat heat transfer tubes 11, so that the liquid refrigerant in the gas liquid two phase refrigerant is gasified and a state change to a gas refrigerant occurs. The gas refrigerant that has flown through the plurality of windward channels 44 and the plurality of leeward channels 45 is supplied to the inside of the header 13, further supplied to the four way valve 8 via the pipe 16, and still further supplied to the compressor 6. In this manner, the heat exchanger of the third embodiment can appropriately function as an evaporator when the air conditioner 1 performs heating operation.

In each of the heat transfer tube insertion spaces 73, a rate of the liquid refrigerant in the gas liquid two phase refrigerant in the vicinity of the ends of the plurality of windward channels 44 is larger than a rate of the liquid refrigerant in the gas liquid two phase refrigerant in the vicinity of the ends of the plurality of leeward channels 45. Therefore, a mass flow rate of the gas liquid two phase refrigerant that flows into the plurality of windward channels 44 increases as compared to a mass flow rate of the gas liquid two phase refrigerant that flows into the plurality of leeward channels 45. As a result, similarly to the heat exchanger 50 as described above, the heat exchanger according to the third embodiment is able to equalize the degree of dryness of the refrigerant that has passed through the plurality of windward channels 44 and the plurality of leeward channels 45 in the plurality of flat heat transfer tubes 11. With this configuration, when the heat exchanger is used as an evaporator, it is possible to achieve an ideal state in which the degree of dryness of the refrigerant that has passed through the heat exchanger reaches approximately 1.0.

In the heat exchanger 50 as described above, due to the gravity, a rate of the liquid refrigerant in the gas liquid two phase refrigerant in the lower portion of the heat transfer tube insertion space 56 may increase as compared to a rate of the liquid refrigerant in the gas liquid two phase refrigerant in the upper portion of the heat transfer tube insertion space 56. In contrast, in the heat exchanger according to the third embodiment, the heat transfer tube insertion space 56 is separated into the plurality of heat transfer tube insertion spaces 73; therefore, as compared to the heat exchanger 50 as described above, it is possible to more equally distribute the amount of refrigerant to be supplied to the plurality of flat heat transfer tubes 11. The heat exchanger according to the third embodiment equalizes the amount of refrigerant to be supplied to each of the flat heat transfer tubes 11, so that it is possible to improve heat exchange performance.

At Time of Cooling Operation

When the air conditioner 1 performs cooling operation, the gas refrigerant that is compressed by the compressor 6 is supplied to the header 13 in the heat exchanger according to the third embodiment from the four way valve 8 via the pipe 16. The gas refrigerant that is supplied to the header 13 is approximately equally supplied to the plurality of channels 43 in the plurality of flat heat transfer tubes 11. The gas refrigerant that flows through the plurality of channels 43 is subjected to heat exchange with air that flows outside the plurality of flat heat transfer tubes 11, so that the gas refrigerant is liquefied and a state change to a liquid refrigerant occurs. The liquid refrigerant that has flown through the plurality of channels 43 is supplied to the plurality of heat transfer tube insertion spaces 73 of the header 51. The liquid refrigerant that is supplied to the plurality of heat transfer tube insertion spaces 73 is supplied to the windward side space 58 via the plurality of windward communication holes 63, and further supplied to the leeward side space 59 via the plurality of leeward communication holes 64. The liquid refrigerant that is supplied to the leeward side space 59 flows downward in the leeward side space 59 and is accumulated in the lower portion of the leeward side space 59. The liquid refrigerant that is accumulated in the lower portion of the leeward side space 59 is supplied to the refrigerant inflow space 23 via the leeward side inflow port 27 of the first partition member 21. The liquid refrigerant that is supplied to the windward side space 58 flows downward in the windward side space 58 and is accumulated in the lower portion of the windward side space 58. When the amount of the liquid refrigerant that is accumulated in the lower portion of the leeward side space 59 is fully reduced, the liquid refrigerant that is accumulated in the lower portion of the windward side space 58 is supplied to the lower portion of the leeward side space 59 via the lower side communication path 29, and supplied to the refrigerant inflow space 23 via the leeward side inflow port 27. The liquid refrigerant that is supplied to the refrigerant inflow space 23 is supplied to the expansion valve 7 via the pipe 15. In this manner, the heat exchanger according to the third embodiment can appropriately function as a condenser when the air conditioner 1 performs cooling operation.

Meanwhile, in the heat exchangers of the second embodiment and the third embodiment as described above, a total area of the plurality of windward communication holes 63 in each of the heat exchangers is larger than a total area of the plurality of leeward communication holes 64; however, the total area of the plurality of windward communication holes 63 may be equal to the total area of the plurality of leeward communication holes 64. Even in this case, because the rate of the liquid refrigerant in the gas liquid two phase refrigerant in the leeward side space 59 is larger than the rate of the liquid refrigerant in the gas liquid two phase refrigerant in the windward side space 58, the heat exchanger is able to increase the amount of gas liquid two phase refrigerant in the plurality of windward channels 44 as compared to the amount of gas liquid two phase refrigerant in the plurality of leeward channels 45. Consequently, even in this case, the heat exchanger is able to improve heat exchange performance between air and a refrigerant.

Meanwhile, in the heat exchangers of the second embodiment and the third embodiment as described above, the plurality of leeward communication holes 64 are formed in the leeward side partition member 54, but the plurality of leeward communication holes 64 need not always be formed. In this case, because the plurality of windward channels 44 of the plurality of flat heat transfer tubes 11 are located closer to the plurality of windward communication holes 63 as compared to the plurality of leeward channels 45, a mass flow rate of the gas liquid two phase refrigerant supplied to the plurality of windward channels 44 increases as compared to a mass flow rate of the gas liquid two phase refrigerant supplied to the plurality of leeward channels 45. Therefore, the heat exchangers of the second embodiment and the third embodiment are able to improve heat exchange performance between air and a refrigerant.

Figure 12:
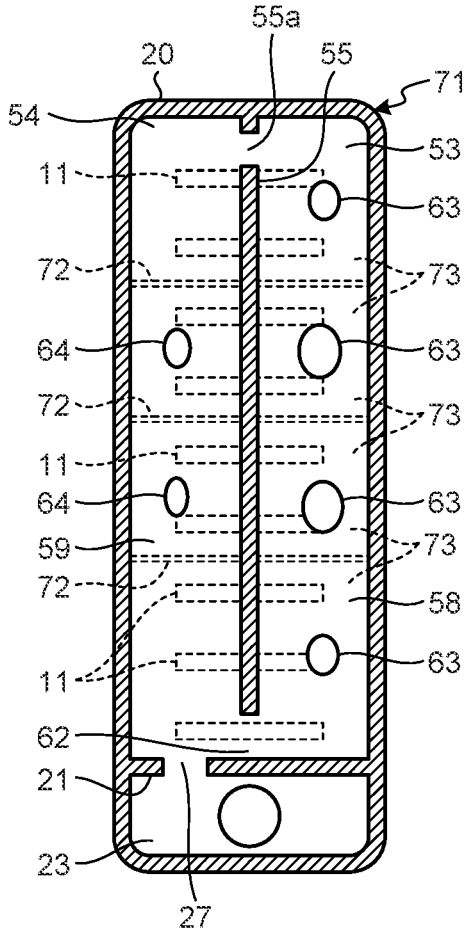
FIG. 12 is a vertical cross sectional view of a header according to another modification.

Meanwhile, while the upper side communication path 28 is formed by separating the upper edge of the second partition member 22 from a member that forms an upper end of the internal space of the main body unit 20, the upper side communication path 28 may be formed by, as illustrated in FIG. 11, forming an upper communication hole 22*a* in an upper portion of the second partition member 22. Similarly, while the upper side communication path 61 is formed by separating the upper edge of the circulation space partition member 55 from a member that forms an upper edge of the internal space of the main body unit 20, the upper side communication path 61 may be formed by, as illustrated in FIG. 12, forming an upper communication hole 55*a* in an upper portion of the circulation space partition member 55. Even if the upper side communication path 28 or the upper side communication path 61 is configured as described above, the heat exchangers of the embodiments are able to improve heat exchange performance between air and a refrigerant. For example, when the upper side communication path 28 is formed by the upper communication hole 22*a*, a step is formed between an upper edge of the leeward side space 25 and an upper edge of the windward side space 24, so that it may be difficult to smoothly supply the liquid refrigerant that is accumulated in the upper portion of the leeward side space 25 to the windward side space 24. In the heat exchanger 5 of the first embodiment as described above, the upper edge of the leeward side space 25 and the upper edge of the windward side space 24 are formed in the same plane, so that as compared to a case in which the upper side communication path 28 is formed by the upper communication hole 22*a*, it is possible to smoothly supply the liquid refrigerant from the leeward side space 25 to the windward side space 24. Similarly, the heat exchangers of the second embodiment and the third embodiment as described above are able to smoothly supply the liquid refrigerant from the leeward side space 59 to the windward side space 58 as compared to a case in which the upper side communication path 61 is formed by the upper communication hole 55*a*. As a result, the heat exchangers of the embodiments as described above are able to improve heat exchange performance between air and a refrigerant as compared to a case in which the upper side communication path 28 is formed by the upper communication hole 22*a* or a case in which the upper side communication path 61 is formed by the upper communication hole 55*a*.

Meanwhile, while the lower side communication paths 29 and 62 are formed in the heat exchangers of the embodiments as described above, the lower side communication paths 29 and 62 need not always be formed. Even in this case, the rate of the liquid refrigerant in the gas liquid two phase refrigerant in the windward side spaces 24 and 58 increases as compared to the rate of the liquid refrigerant in the gas liquid two phase refrigerant in the leeward side spaces 25 and 59, so that the heat exchangers are able to increase the amount of the gas liquid two phase refrigerant in the plurality of windward channels 44 as compared to the amount of the gas liquid two phase refrigerant in the plurality of leeward channels 45. Therefore, even in this case, the heat exchangers are able to improve heat exchange performance between air and a refrigerant.

Thus, while the embodiments have been described above, the embodiments are not limited to the contents as described above. In addition, the components as described above include one that can be easily thought of by a person skilled in the art, one that is practically identical, and one that is within an equivalent range. Furthermore, the components as described above may be appropriately combined. Moreover, within the scope not departing from the gist of the following embodiments, at least any of various omission, replacement, and modifications of the components may be made.

REFERENCE SIGNS LIST

1 air conditioner
4, 5 heat exchanger
11 flat heat transfer tubes
12 header
13 header
20 main body unit
21 first partition member
22 second partition member
23 refrigerant inflow space
24 windward side space
25 leeward side space
27 leeward side inflow port
28 upper side communication path
29 lower side communication path
42 distribution direction
44 windward channels

45 leeward channels
50 heat exchanger
51 header
53 windward side partition member
54 leeward side partition member
55 circulation space partition member
56 heat transfer tube insertion space
57 circulation space
58 windward side space
59 leeward side space
61 upper side communication path
62 lower side communication path
63 windward communication holes
64 leeward communication holes
71 header
72 partition members
73 heat transfer tube insertion spaces

The invention claimed is:

1. A heat exchanger comprising:

a plurality of flat heat transfer tubes that are arranged in a region in which air flows; and a header that is bonded to end portions of the plurality of flat heat transfer tubes, wherein each of the plurality of flat heat transfer tubes internally includes a plurality of windward channels; and a plurality of leeward channels that are arranged on a leeward side of the air relative to the plurality of windward channels, the header includes a main body unit having an internal space;

a first partition member that separates the internal space into: a refrigerant inflow space to which a refrigerant flows from a pipe; and an upper space that is arranged at an upper side of the refrigerant inflow space, and connected to the plurality of windward channels and the plurality of leeward channels; and a second partition member that separates a windward side space at a side closer to end portions of the plurality of windward channels in the upper space and a leeward side space at a side closer to end portions of the plurality of leeward channels in the upper space, the first partition member is provided with a leeward side inflow port that allows communication between the refrigerant inflow space and the leeward side space to cause the refrigerant to gush out towards an upper portion of the leeward side space, and an upper side communication path that allows communication between the leeward side space and the windward side space is formed in an upper portion of the second partition member.

2. The heat exchanger according to claim 1, wherein a lower side communication path that allows communication between the leeward side space and the windward side space is formed in a lower portion of the second partition member.

3. The heat exchanger according to claim 1, wherein the header further includes a windward side partition member that separates an insertion space in which end portions of the plurality of windward channels and end portions of the plurality of leeward channels are arranged in the upper space, and the windward side space in the upper space; and a leeward side partition member that separates the insertion space and the leeward side space, and a plurality of windward communication holes that allow communication between the insertion space and the windward side space are formed in the windward side partition member.

4. The heat exchanger according to claim 3, wherein a plurality of leeward communication holes that allow communication between the insertion space and the leeward side space are formed in the leeward side partition member.

5. The heat exchanger according to claim 3 further comprising:

a plurality of partition members that separate the insertion space into a plurality of spaces, wherein the plurality of windward communication holes allow communication between the plurality of spaces and the windward side space, respectively, and an end portion of any of the plurality of flat heat transfer tubes is arranged in each of the plurality of spaces.

6. The heat exchanger according to claim 1, wherein the upper side communication path is formed such that an upper edge of the leeward side space and an upper edge of the windward side space are connected to each other without a step.

* * * * *